United States Patent [19]

Kawai et al.

[11] 3,991,727

[45] Nov. 16, 1976

[54] ELECTRONICALLY CONTROLLED FUEL INJECTION SYSTEM

[75] Inventors: Hisasi Kawai, Toyohashi; Ritsu Katsuoka, Okazaki, both of Japan

[73] Assignee: Nippon Soken, Inc., Nishio, Japan

[22] Filed: Apr. 30, 1975

[21] Appl. No.: 573,153

[30] Foreign Application Priority Data

June 14, 1974 Japan ..... 49-68577

[52] U.S. Cl. ..... 123/32 EA; 235/150.21

[51] Int. Cl.[2] ..... F02B 3/00

[58] Field of Search ..... 123/32 EA; 235/150.21

[56] References Cited

UNITED STATES PATENTS

| | | | |
|---|---|---|---|
| 3,817,225 | 6/1974 | Priegel | 123/32 EA |
| 3,862,404 | 1/1975 | Fiedrich | 123/32 EA |
| 3,898,962 | 8/1975 | Honig et al. | 123/32 EA |
| 3,904,856 | 9/1975 | Monpetit | 123/32 EA |
| 3,906,207 | 9/1975 | Rivere et al. | 123/32 EA |

*Primary Examiner*—Charles J. Myhre
*Assistant Examiner*—Paul Devinsky
*Attorney, Agent, or Firm*—Cushman, Darby & Cushman

[57] ABSTRACT

There is provided an electronically controlled fuel injection system wherein a constant presetting circuit generates a proportionality constant signal having a frequency corresponding to a proportionality constant, an intake-air amount detecting circuit generates a binary coded signal corresponding to the amount of air drawn into an internal combustion engine, and a multiplier circuit multiplies the proportionality constant signal by this binary coded signal and generates an output signal having a frequency corresponding to the product of the two signals. On the other hand, an engine revolution detecting circuit generates an engine revolution signal having a pulse width inversely proportional to the number of revolutions of the engine, and the number of multiple signals generated from the multiplier circuit during the pulse width of the engine revolution signal is counted to generate a binary coded signal representing the fuel injection quantity required by the engine. A converter circuit generates a pulse signal having a time width corresponding to the binary coded signal representing the required fuel injection quantity and the pulse signal is used to operate fuel injection valves.

8 Claims, 11 Drawing Figures

ELECTRONICALLY CONTROLLED FUEL INJECTION SYSTEM

BACKGROUND OF THE INVENTION

1. FIELD OF THE INVENTION

The present invention relates to an electronically controlled fuel injection system in which computational operations are performed by employing as principal engine operating parameters the amount of air drawn into an internal combustion engine and the number of revolutions of the engine, and the proper fuel injection quantity is computed in the form of a digital quantity to inject fuel into the engine.

2. DESCRIPTION OF THE PRIOR ART

Electronically controlled fuel injection systems are known in the art in which electronic elements such as capacitors, resistors, transistors, etc. are employed, and the required fuel injection quantity is analogically computed in accordance with the values representing the amount of air drawn into the engine and the number of revolutions of the engine as principal engine parameters and the values representing the engine cooling water temperature, wide-open throttle, idling condition, engine start, voltage variation, etc. constituting auxiliary engine parameters to thereby inject the proper amount of fuel into the engine. A disadvantage of the conventional system of such analog type is that the effects of the deterioration of the electronic elements with temperature and time are so great that the operation of the system is rendered unstable. Another disadvantage of this type of conventional system is that the adjustment is required at a number of places because of the variations in the performance of the electronic elements of the similar type or kind, and moreover the occurrence of electrical noise due to the high tension discharge in the ignition circuit or the like causes the system to operate unstably.

SUMMARY OF THE INVENTION

It is the object of the present invention to provide an electronically controlled fuel injection system which is capable of digitally computing the proper quantity of fuel injected into an internal combustion engine.

In accordance with the present invention, there is thus provided an electronically controlled fuel injection system comprising fuel injection means for injecting fuel into an internal combustion engine, a constant presetting circuit for generating a constant signal having a frequency corresponding to a predetermined constant, an intake-air amount detecting circuit for generating a binary coded intake-air amount signal corresponding to the amount of air drawn into the engine, an engine revolution detecting circuit for generating an engine revolution signal having a time width inversely proportional to the number of revolutions of the engine, an oscillator circuit for generating clock signals having a preset frequency, a multiplier circuit for multiplying the constant signal in accordance with the intake-air amount signal and generating a multiple signal having a frequency corresponding to the product of the constant and the intake-air amount, a logical operation circuit for performing the logical operation on the multiple signals and the engine revolution signal and generating a binary coded injection quantity signal indicative of a fuel injection quantity per a predetermined rotation of the engine, and a converter circuit for actuating the fuel injection means in accordance with the injection quantity signal, whereby the proper fuel injection quantity is computed digitally, the system is not subjected to the influence of deterioration with temperature, deterioration with time, external electrical noise, etc. to ensure stable operation thereof, and the construction of the circuitry for computing the fuel injection quantity is simplified considerably with the use of integrated circuits thus reducing the manufacturing cost of the system.

DESCRIPTION OF THE PREFERRED EMBODIMENT

The present invention will now be described in greater detail with reference to the embodiment shown in the accompanying drawings.

Figure 1:
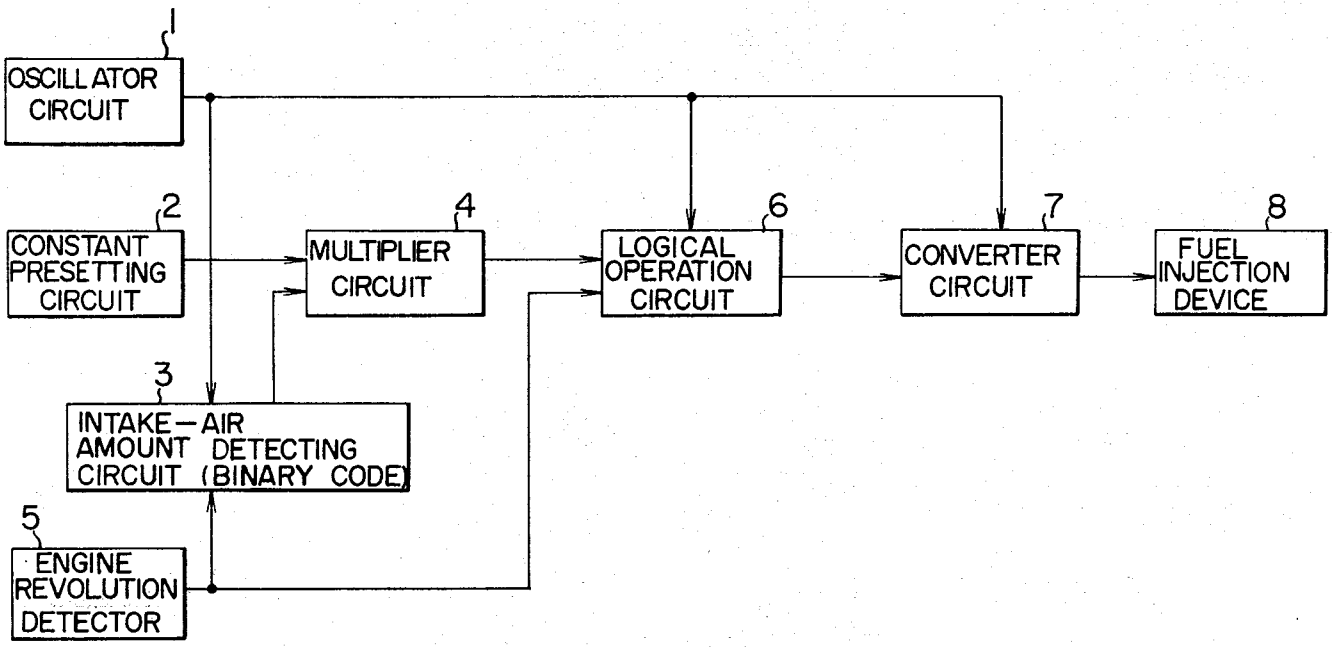
FIG. 1 is a block diagram showing the general construction of an embodiment of an electronically controlled fuel injection system according to the present invention.

Referring first to FIG. 1 illustrating the general construction of an electronically controlled fuel injection system according to the present invention, numeral 1 designates an oscillator circuit for generating clock signals having a predetermined frequency, 2 a constant presetting circuit for generating a constant signal having a frequency corresponding to a constant predetermined in accordance with the characteristic of an internal combustion engine, 3 an intake-air amount detecting circuit for generating a binary-coded intake-air signal, 4 a multiplier circuit for multiplying the frequency of the constant signal in accordance with the intake-air amount signal and generating a multiple signal, 5 an engine revolution detecting circuit for generating an engine revolution signal having a time width inversely proportional to the number of revolutions of the engine, 6 a logical operation circuit for computing the proper fuel injection quantity in accordance with the multiple signals supplied from the multiplier circuit 5 and the engine revolution signal from the engine revolution detecting circuit 5 and generating a binary-coded injection quantity signal, 7 a converter circuit for generating a pulse signal having a time width corresponding to the injection quantity signal, 8 fuel injection means for injecting fuel into the engine.

The operation of the preferred embodiment of the electronically controlled fuel injection system according to the present invention will now be described briefly. With the known type of gasoline internal combustion engine, if fuel is fed into the engine in an amount proportional to the amount of air drawn into the engine, the proper fuel quantity required by the engine can be supplied thus accomplishing the optimium condition for the exhaust gas purifying purposes. Consequently, if an intake-air amount Q detected by the intake-air amount detecting circuit 3 is multiplied by a proportionality constant K from the constant presetting circuit 2 and the resulting product K·Q is divided by engine revolutions N from the engine revolution detecting circuit 5, it is possible to compute the proper fuel injection quantity required by the engine. In accordance with the present invention, this fuel injection quantity is digitally computed. On other words, the constant presetting circuit 2 generates a constant signal having a frequency $f$ corresponding to the proportionality constant K, the intake-air amount detecting circuit 3 generates a binary-coded signal corresponding to the intake-air amount Q and the multiplier circuit 4 multiplies the constant signal in accordance with the intake-air amount Q and generates a multiple signal having a frequency $Q \cdot f_K$. On the other hand, the engine revolution detecting circuit 5 generates an engine revolution signal having a time width $T_N$ inversely proportional to the engine revolutions N, and the logical operation circuit 6 counts the number of the multiple signals generated during the time width $T_N$ of the engine revolution signal. The resulting binary-coded output of the logical operation circuit 6 undoubtedly represents the proper fuel injection quantity K·Q/N required by the engine. The binary-coded output of the logical operation circuit 6 is then converted into a time duration by the converter circuit 7, and the fuel injection means 8 is operated to inject the required fuel into the engine.

While the constant signal having the frequency $f_K$ is multiplied by the multiplier circuit 4 in accordance with the intake-air amount Q thus generating the resulting multiple signal having the frequency $Q \cdot f_K$, the multiplier circuit 4 uses a known type of phase lock loop (P.L.L) and its operating principle will be described in reference to FIGS. 2 and 3 hereunder.

Figure 2:
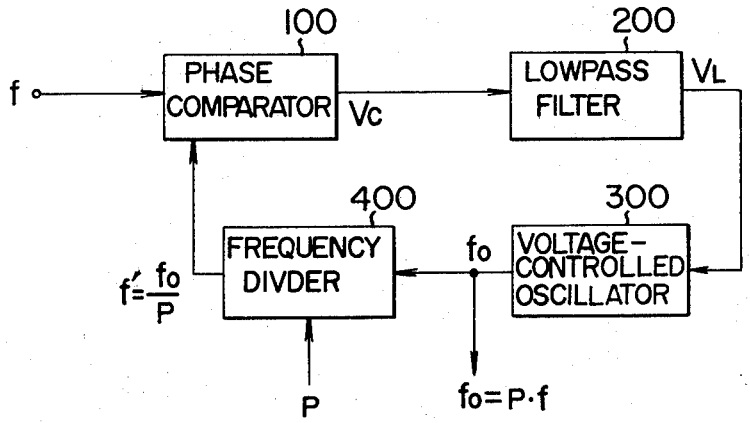
FIG. 2 is a block diagram showing the phase lock loop used in the embodiment of FIG. 1.
Figure 3:
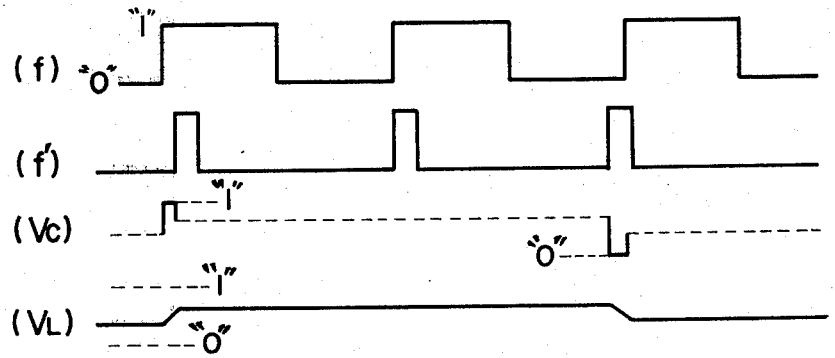
FIG. 3 is a signal waveform diagram useful in explaining the operation of the phase lock loop shown in FIG. 2.

In FIG. 2, numeral 100 designates a phase comparator, 200 a low-pass filter, 300 a voltage-controlled oscillator, 400 a frequency divider having a division ratio of P to 1. Assuming now that the frequency of the input signal to the phase comparator 100 is $f$ and the frequency of the output signal of the voltage controlled oscillator 300 is $f_O$, the phases of the input signal ($f$) and the feedback signal ($f'$) shown in FIG. 3 are compared with each other, so that when the rising of the input signal ($f$) precedes the rising of the feedback signal ($f'$) a "1" level is generated for the duration of this preceding time as shown by the waveform ($V_c$) of FIG. 3, whereas when the rising of the feedback signal ($f'$) precedes the rising of the input signal ($f$) a "0" level is generated for the duration of this preceding time. The phase comparator 100 remains in the non-operated condition under the other conditions. Consequently, the low-pass filter 200 generates the output voltage ($V_L$) shown by the waveform ($V_L$) of FIG. 3 which varies in accordance with the duration time of the "1" level and "0" level of the output signal of the phase comparator 100, while the oscillation frequency of the voltage-controlled oscillator 300 is controlled to the output voltage ($V_L$) of the low-pass filter 200 and the voltage-controlled oscillator 300 generates the output signal having the frequency $f_O$. The frequency divider 400 divides the frequency $f_O$ of this output signal by a factor of P thus generating an output signal having a frequency $f_O$/P. By feeding back the output signal of the frequency divider 400 to the phase comparator 100 as the feedback signal ($f'$), during the time that the input signal ($f$) to the phase comparator 100 is circulated several times through the closed loop the variation of the output voltage ($V_L$) of the low-pass filter 200 is decreased and the phase of the input signal ($f$) is eventually maintained in step with the phase of the feedback signal ($f'$), thus bringing the closed loop to a stable condition. Under this stable condition, an equation $f = f_O/P$ holds between the frequencies of the input signal ($f$) and the feedback signal ($f'$) and thus the oscillation frequency of the voltage-controlled oscillator 300 becomes $f_O = P.f$. In this way, the phase lock loop is used to multiply the frequency of the input signal to generate an output signal having the frequency $P \cdot f$.

Next, the detailed construction and operation of the individual circuits used in the embodiment of FIG. 1 will be described. In this embodiment, the constant presetting circuit 2 takes into account the temperature of engine cooling water, idling condition and wide open throttle condition as auxiliary operating parameters of the engine, and the logical operation circuit 6 takes into account the starting of the engine and the variation of the voltage applied to the fuel injection nozzles as auxiliary engine parameters. While the oscillator circuit 1 will not be described in any detail since it may be comprised of a known type of crystal oscillator, the oscillator circuit 1 generates clock signals having a predetermined frequency.

Figure 4:
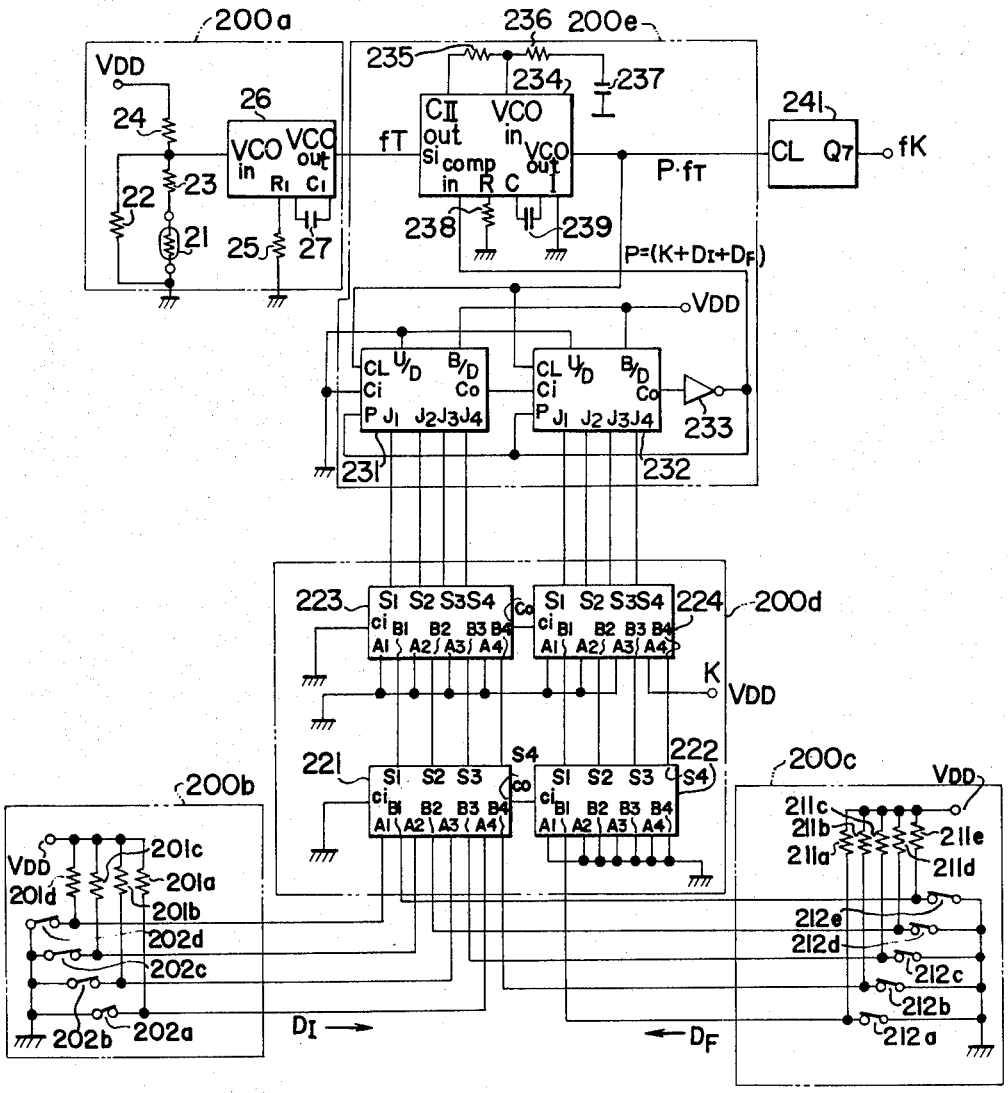
FIG. 4 is a wiring diagram showing an embodiment of the constant presetting circuit used in the embodiment of FIG. 1.

As shown in FIG. 4, the constant presetting circuit 2 comprises cooling water temperature signal generating means including a thermistor 21 whose resistance value changes with the temperature of engine cooling water, resistors 22, 23 and 24, a conventional voltage-controlled oscillator 26 (such as the RCA CD 4046) whose oscillation frequency varies in accordance with the input voltage, an oscillating resistor 25 and an oscillating capacitor 27 whereby to generate a cooling water temperature signal having a frequency $f_T$ corresponding to the engine cooling water temperature; idling extra quantity presetting means including resistors 201*a*, 201*b*, 201*c* and 201*d* and normally closed switches 202*a*, 202*b*, 202*c* and 202*d* which are opened only when the engine is idling whereby to generate a binary-coded output corresponding to an idling extra quantity $D_I$; wide open throttle extra quantity presetting means including resistors 211*a*, 211*b*, 211*c*, 211*d* and 211*e* and normally closed switches 212*a*, 212*b*, 212*c*, 212*d* and 212*e* which are opened only under the wide open throttle condition whereby to generate a binary-coded output corresponding to a wide open throttle extra quantity $D_F$; adding means including parallel adders 221, 222, 223 and 224 (such as the RCA CD4008) with the parallel adders 221 and 222 connected in cascade and the parallel adders 223 and 224 connected in cascade; multiplying means including presettable counters 231 and 232 (such as the RCA CD4029) which are connected in cascade, an inverter 233, a voltage-controlled oscillator 234 (such as the RCA CD4046) which is provided with a phase comparing function, resistors 235 and 236 and a capacitor 237 constituting a low-pass filter, an oscillating resistor 238 and an oscillating capacitor 239; and a binary counter 241 (such as the RCA DC4040).

In the constant presetting circuit 2, the multiplying means operates in a similar manner as the phase lock loop (P.L.L) shown in FIG. 2, while the coolling water temperature signal having the frequency $f_T$ is coupled to the signal input terminal (*Si*) of the voltage-controlled oscillator 234 including a phase comparator, and the frequency divided output terminal ($C_O$) of the presettable counter 232 is connected through the inverter 233 to the feedback input terminal (COMP in) of the voltage-controlled oscillator 234. Consequently, if the preset value of the presettable counters 231 and 232 is represented by P, then an output signal having a frequency $P \cdot f_T$ is generated at the output ($V_{co}$ out) of the voltage-controlled oscillator 234 in accordance with the operating principle described in connection with FIGS. 2 and 3. Further, the output (C II out) of the phase comparator in the voltage-controlled oscillator 234 is connected through the low-pass filter to the input ($V_{CO}$ in) of the voltage-controlled oscillator 234. The presettable counters 231 and 232 are used as backward counters and their output terminal ($C_O$) is connected to their data input control terminals (P) through the inverter 233 thus forming a frequency divider having 8-bit binary coded preset inputs and adapted for dividing the frequency of input signals. In this embodiment, the preset value P represents a sum of the idling extra fuel quantity, the wide open throttle extra fuel quantity and a fixed constant K, and this sum is produced by the adding means. In this embodiment, as shown in FIG. 4, the idling extra quantity and the wide open throttle extra quantity are respectively supplied in the form of a 4-bit binary coded input and a 5-bit binary coded input and these inputs are added to the fixed constant K (K = 128 in this embodiment) by the parallel adders 221 through 224. The result of the addition is applied as a preset input to the presettable counters 231 and 232 thus producing an output $P = (K + D_I + D_F)$. Assuming that $D_I = K \cdot D'_I$ and $D_F = K \cdot D'_F$, then an output signal having a frequency $P \cdot f_T = K \cdot f_T (1 + D'_T + D'_F)$ is generated at the output ($V_{CO}$ out) of the voltage-controlled oscillator 234. This output signal is then subjected to a frequency division by a factor of P in the binary counter 241 thus generating a constant signal having a frequency $f_K = f_T (1 + D'_I + D'_F)$. In this way, the constant signal having the frequency $f_K$ corresponding to the predetermined constant is generated at the output terminal of the binary counter 241 in the constant presetting circuit 2.

Figure 5:
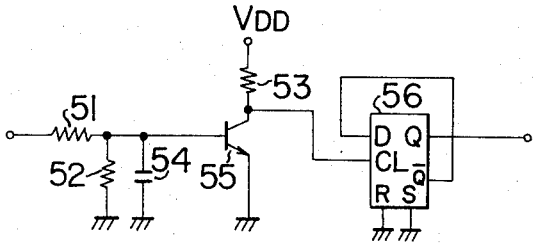
FIG. 5 is a wiring diagram showing an embodiment of the engine revolution detecting circuit used in the embodiment of FIG. 1.
Figure 11:
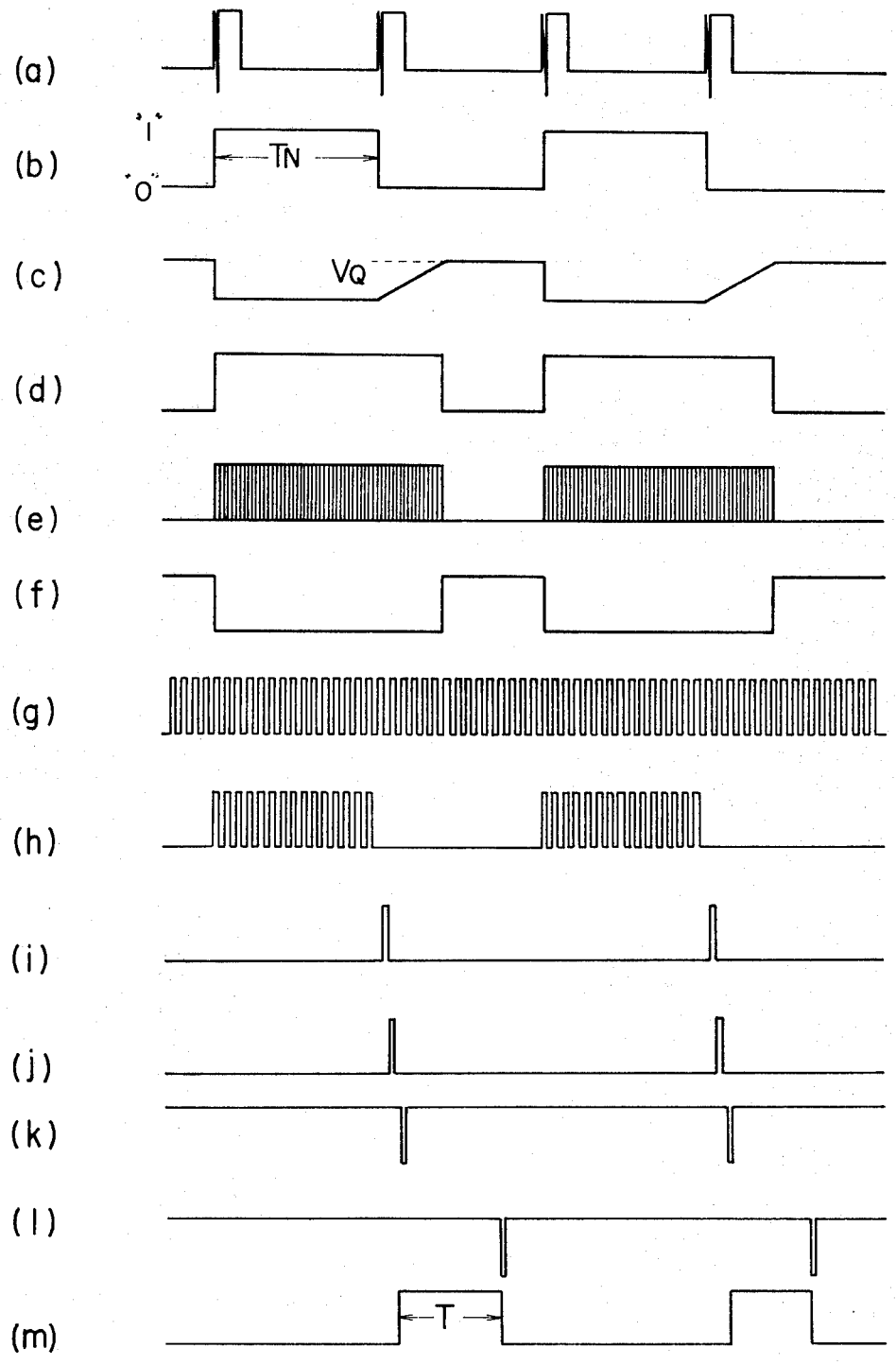
FIG. 11 is a diagram showing signal waveforms generated at various points in the embodiment of FIG. 1.

Next, the engine revolution detecting circuit 5 will be described first. The engine revolution detecting circuit 5 receives as its input signals the signals generated by the making and breaking of the points in a known type of distributor which is not shown. As shown in FIG. 5, the engine revolution detecting circuit 5 comprises resistors 51, 52 and 53, a capacitor 54, a transistor 55 and a D-type flip-flop 56. As a result, in case of a four-cylinder, four-cycle engine, for example, the four make and break signals shown by the waveform (*a*) of FIG. 11 are generated by the points of the distributor for every complete rotation of the engine at intervals of 180° of crank angle to turn on and off the transistor 55, and thus the D-type flip-flop 56 generates at its Q output the engine revolution signals shown by the waveform (*b*) of FIG. 11, i.e., the make and break signals subjected to a 2 : 1 frequency division. It is apparent that a time width $T_N$ of the engine revolution signal is inversely proportional to the revolutions N of the engine.

Figure 6:
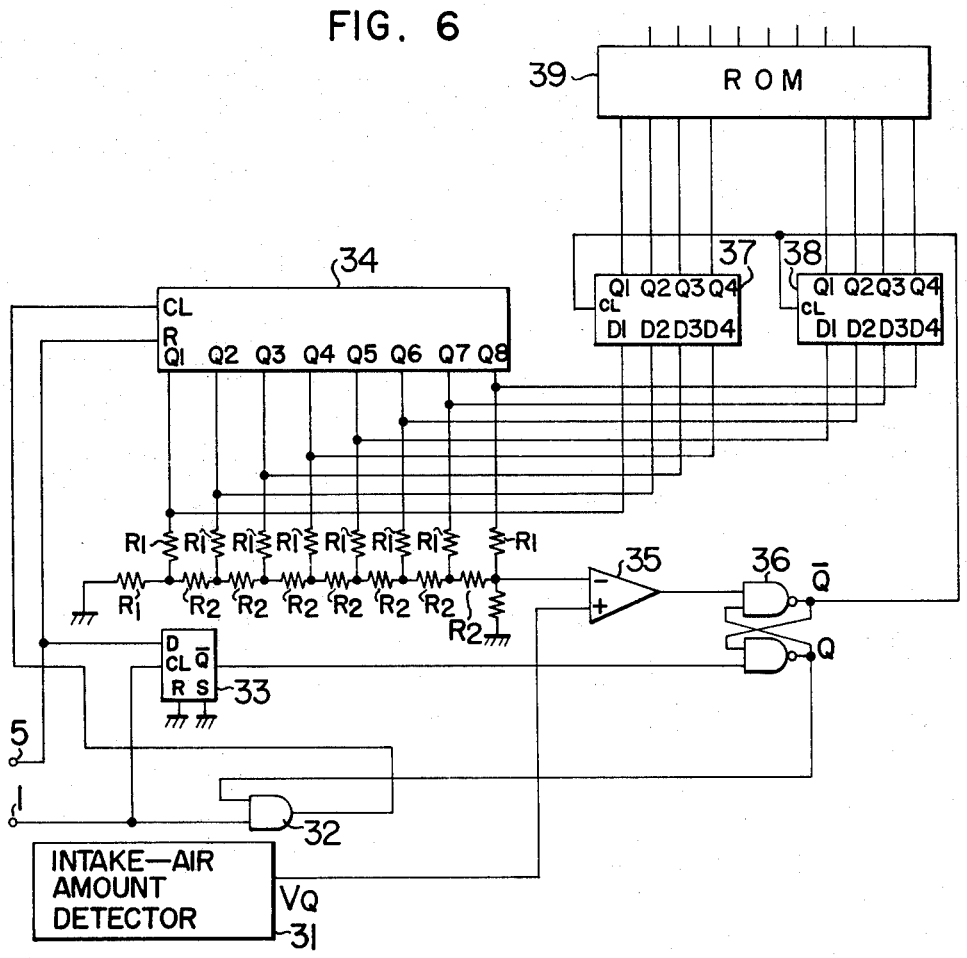
FIG. 6 is a wiring diagram showing an embodiment of the intake-air amount detecting circuit used in the embodiment of FIG. 1.
Figure 7:
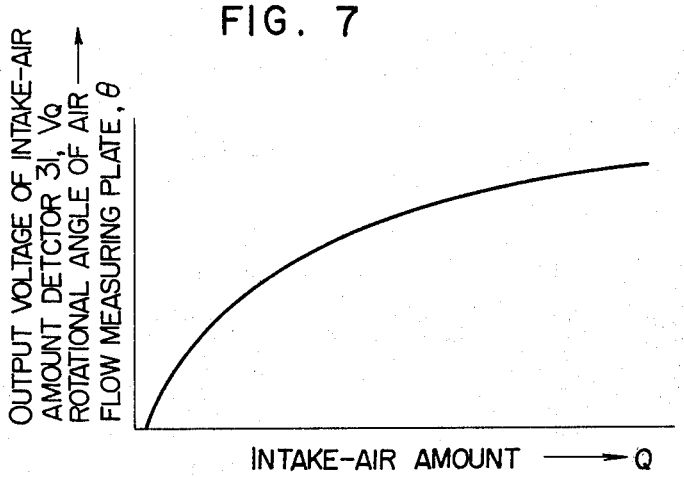
FIG. 7 is a characteristic diagram of the intake-air amount detecting circuit shown in FIG. 6.

The intake-air amount detecting circuit 3 comprises, as shown in FIG. 6, an intake-air amount detector 31, an AND gate 32, a signal delaying D-type flip-flop 33 (such as the RCA CD4013), a binary counter 34, a ladder type network of resistors having resistance values $R_1$ and $R_2$, a voltage comparator 35, an R-S flip-flop 36, memories 37 and 38 (such as the RCA CD4042) and an ROM 39 (a read-only memory such as the Harris ROM HPROM1025). The intake-air amount detector 31 is of the known type in which the output voltage of a potentiometer varies in accordance with the rotational angle of an air flow measuring plate mounted in the suction duct of the engine, and the value of rotational angle $\theta$ of the air flow measuring plate and the value of output voltage $V_Q$ of the potentiometer bear a nonlinear relationship to the value of intake-air amount Q as shown in FIG. 7. The ROM 39 is of the known type which generates a preliminarily programmed binary coded output in response to a definite binary coded input, and in the illustrated embodiment the ROM 39 is programmed so that it has an input-output characteristic corresponding to the characteristic of the intake-air amount detector 31 shown in FIG. 7.

Referring again to FIG. 6, the output voltage $V_Q$ of the intake-air amount detector 31 is applied to the noninverting input (+) of the voltage comparator 35 and the inverting input (−) of the voltage comparator 35 is connected to the output of the resistance ladder type network, while the data input terminal (D) of the D-type flip-flop 33 and the reset terminal (R) of the binary counter 34 are connected to the output terminal of the engine revolution detecting circuit 5, and the clock input terminal (CL) of the D-type flip-flop 33 is connected to the output terminal of the oscillator circuit 1.

Figure 8:
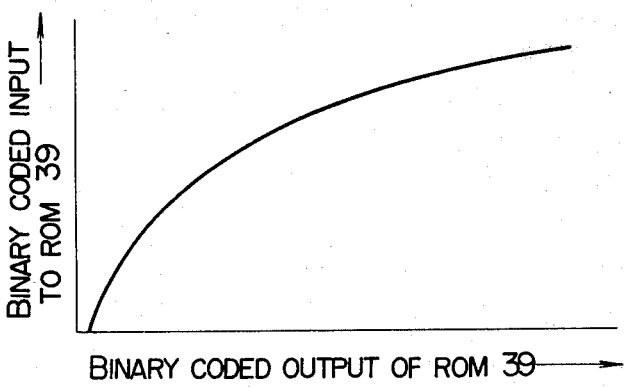
FIG. 8 is a programming characteristic of the read-only memory used in the intake-air amount detecting circuit shown in FIG. 6.

When the engine revolution signal generated from the engine revolution detecting circuit 5 and shown by the waveform (*b*) of FIG. 11 goes to a "1" level, the binary counter 34 is reset and the inverting input of the voltage comparator 35 goes to zero volt as shown by the waveform (*c*) of FIG. 11 thus causing the output of the voltage comparator 35 to go to the "1" level. At the expiration of one clock period thereafter, the D-type flip-flop 33 causes its inverted output $\overline{Q}$ to go to the "0" level and the R-S flip-flop 36 is set thus causing its $\overline{Q}$ output to go to the "0" level. At this time, a signal of opposite phase ("1" level) with respect to that at the $\overline{Q}$ output is generated at the Q output of the R-S flip-flop 36 as shown by the waveform (*d*) of FIG. 11. When the engine revolution signal (*b*) advances half a period so that it goes to the "0" level, the binary counter 34 starts to count the number of clock signals from the oscillator circuit 1 and the voltage at the inverting input of the voltage comparator 35 increases in a step fashion in accordance with the number of the clock signals as shown by the waveform (*c*) of FIG. 11. As the instant that the voltage (*c*) becomes greater than the output voltage ($V_Q$) of the intake-air amount detector 31, the output of the voltage comparator 35 is inverted and the R-S flip-flop 36 is reset thus causing its Q output to go to the "0" level as shown by the waveform (*d*) of FIG. 11. When this occurs, the AND gate 32 prevents the application of the clock signals from the oscillator circuit 1 to the binary counter 34 as shown by the waveform (*e*) of FIG. 11, and thus the binary counter 34 maintains its count attained by that time. At the same time, the $\overline{Q}$ output of the R-S flip-flop 36 goes to the "1" level as shown by the waveform (*f*) of FIG. 11, and consequently the output of the binary counter 34 which was attained at the time that the binary counter 34 stopped its counting is generated in binary code form from the memories 37 and 38. Since the outputs of the memories 37 and 38 can change only when their clock terminals (CL) are at the "1" level, the binary coded output from the memories 37 and 38 is maintained until the engine revolution signal shown by the waveform (*b*) of FIG. 11 goes to the next period and the $\overline{Q}$ output of the R-S flip-flop 36 again goes to the "1" level. Further, since the binary coded output of the memories 37 and 38 is proportional to the rotational angle $\theta$ of the air flow measuring plate but it is not proportional to the intake-air amount Q, the ROM 39 having preliminarily programmed therein the input-output characteristic shown in FIG. 8 generates a binary coded output proportional to the intake-air amount Q.

While the multiplier 4 will not be described in any detail since it employs the phase lock loop (P.L.L) described in connection with FIGS. 2 and 3 and hence its detailed construction is the same as the multiplying means of the constant presetting circuit 2 shown in FIG. 4, the constant signal generated from the constant presetting circuit 2 and having the frequency $f_K = f_T \cdot (1 + D'_I + D'_F)$ is multiplied by the preset value representing the intake-air amount Q thus generating a multiple signal having a frequency $Q \cdot f_K$.

Figure 9:
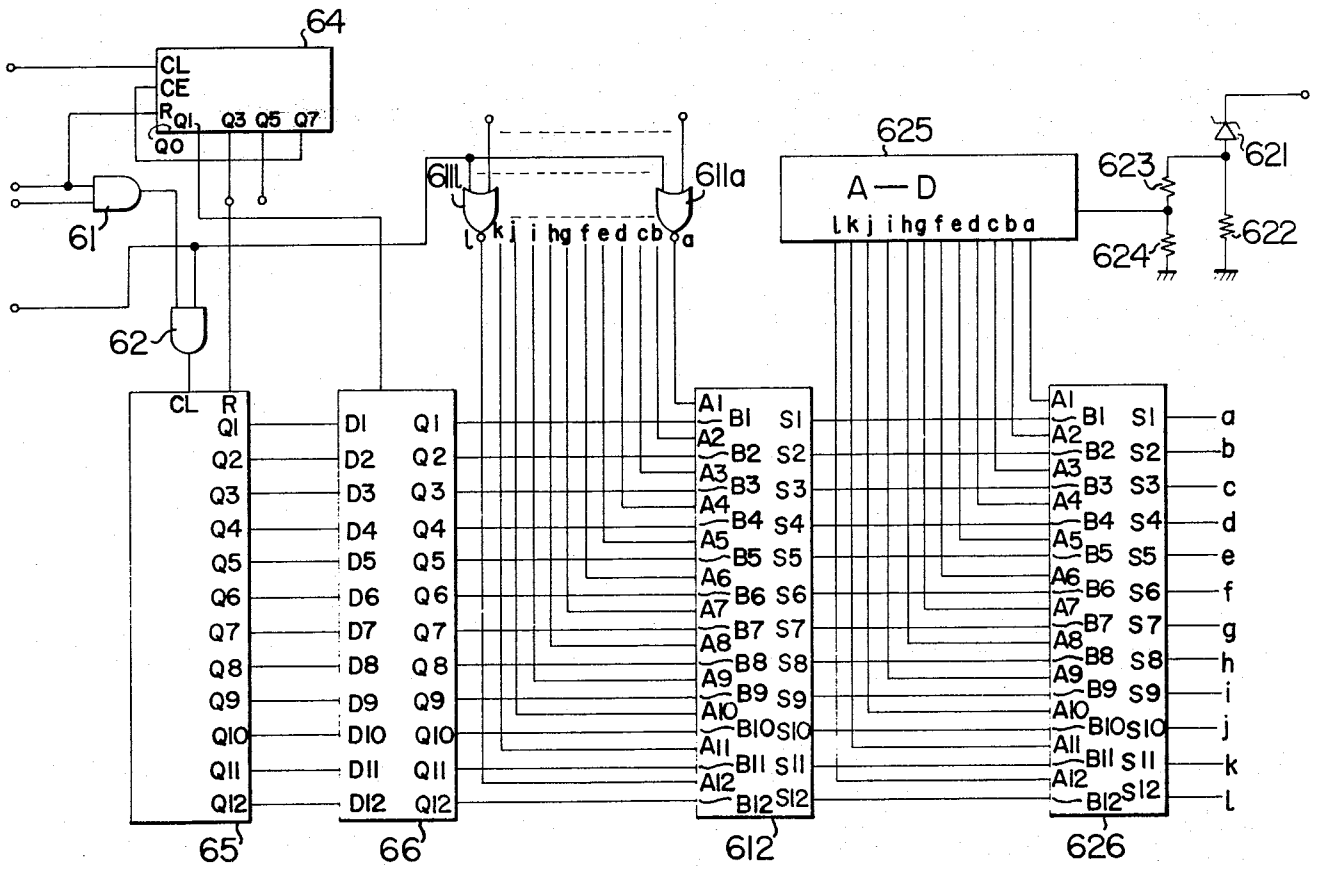
FIG. 9 is a wiring diagram showing an embodiment of the logical operating circuit used in the embodiment of FIG. 1.

As shown in FIG. 9, the logical operation circuit 6 comprises logical computing means including AND gates 61 and 62, a divider and counter 64 (such as the RCA CD4040), a binary counter 65 (such as the RCA CD4040) and a memory 66 (such as the RCA CD4042), engine start extra quantity presetting means including NOR gates 611*a* through 611*l* and a parallel adder 612 (such as the RCA CD4008) and voltage compensation extra fuel quantity presetting means including a Zener diode 621, resistors 622, 623, 624, and A-D converter 625 for generating a binary coded output corresponding to its input voltage and a parallel adder 626. The divider and counter 64 has its clock terminal (CL) connected to the output terminal of the oscillator circuit 1 and its reset terminal (R) connected to the output terminal of the engine revolution detecting circuit 5 along with one input of the AND gate 61, the other input of the AND gate 61 is connected to the output terminal of the multiplier circuit 4, one input of the AND gate 62 is connected to one inputs of the NOR gates 611*a* through 611*l* of the engine start extra quantity presetting means so that a "0" level is applied to the one inputs of the NOR gates 611*a* through 611*l* only when the starter (not shown) is brought into operation, and the other inputs of the NOR gates 611*a* through 611*l* are normally preset to either "0" or "1"level. The detailed construction of the A-D converter 625 will not be described since it may be comprised of a voltage-controlled oscillator and a binary counter. The logical operation circuit 6 operates as follows. When the multiple signals from the multiplier circuit 4 having the frequency $f_K \cdot Q$ and shown by the waveform (*g*) of FIG. 11 and the engine revolution signal from the engine revolution detecting circuit 5 having the time width $T_N$ inversely proportional to the engine revolutions and shown by the waveform (*b*) of FIG. 11 are applied to the AND gate 61, a number of clock signals inversely proportional to the engine revolutions N, that is, the clock signals amounting to a total of $f_K \cdot Q/N$ are intermittently generated at the output of the AND gate 61 as shown by the waveform (*h*) of FIG. 11.

On the other hand, at the instant that the engine revolution signal changes from the "1" level to the "0" level, the divider and counter 64 starts counting the number of clock signals and the "1"level is sequentially shifted through its outputs $Q_0$ to $Q_7$ in accordance with the number of the applied clock signals. When the "1" level is eventually generated at the $Q_7$ output, the clock inhibit terminal (CE) goes to the "1" level so that the divider and counter 64 stops the counting and this state is maintained until a "1" level is again applied to its reset terminal (R) connected to the engine revolution detecting circuit 5. In this case, at the instant that the output terminal $Q_3$ of the divider and counter 64 goes to the "1" level as shown by the waveform (*j*) of FIG. 11, the binary counter 64 is reset to count the signals shown by the waveform (*h*) of FIG. 11 and applied through the AND gate 62. When the divider and counter 64 generates at its $Q_1$ output terminal the "1" level shown by the waveform (*i*) of FIG. 11 in the previously described manner after the binary counter 64 has completed the count operation, the memory 66 stores in binary code form the number of the clock signals counted by the binary counter 64. After the next two clocks, the divider and counter 64 again generates a "1" level at its $Q_3$ output thus resetting the binary counter 65.

While the binary counter 65 performs the count operation and the memory 66 stores the count of the binary counter 65 in the manner described above excepting when the starter is in operation, a "0" level is applied to the AND gate 62 when the starter is brought into operation for starting the engine so that the signals from the AND gate 61 are blocked by the AND gate 62 and the outputs of the memory 66 go to the "0" level. In this case, only those of the NOR gates 611*a* through *l* to which the "0" level is normally applied generate a "1" level at their outputs and only a binary coded input corresponding to an engine start extra quantity $D_S$ is applied to the parallel adder 612. In other words, when the engine is in operation the engine start extra quantity $D_S$ is zero and hence the binary coded output of the parallel adder 612 is equal to the binary coded output of the memory 66, whereas during the starting period of the engine the binary coded output of the parallel adder 612 becomes equal to the binary coded output produced by the NOR gates 611*a* through 611*l.* Namely, the binary coded output of the parallel adder 612 corresponds to the engine start extra quantity $D_S$ during the starting period of the engine, while it corresponds to the number $f_K \cdot Q/N$ when the engine is in operation. The binary coded output of the parallel adder 612 is added in the parallel adder 626 to its binary coded input which corresponds to a voltage compensation extra quantity $D_E$. In other words, in the voltage compensation presetting means the A-D converter 625 generates a binary coded output in accordance with the variation in the voltage of a battery (not shown) which is connected to one end of the Zener diode 621 and this binary coded output is added to the binary coded output of the parallel adder 612 in the parallel adder 626 thus accomplishing the required compensation of the fuel injection quantity. In this way, the logical operation circuit 6 generates a binary coded injection quantity signal corresponding to the thus compensated fuel injection quantity $(f_K \cdot Q/N) + D_S + D_E$.

Figure 10:
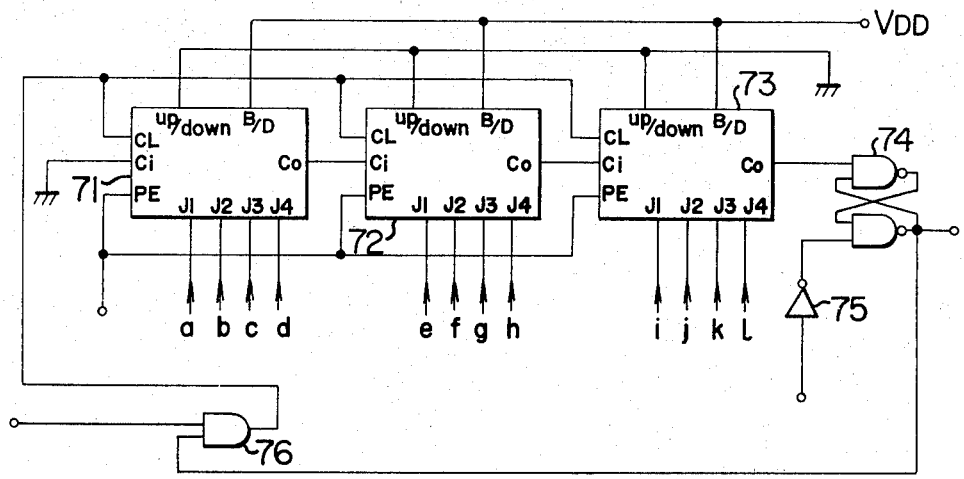
FIG. 10 is a wiring diagram showing an embodiment of the converter circuit used in the embodiment of FIG. 1.

The converter circuit 7 comprises, as shown in FIg. 10, presettable counters 71, 72 and 73 which are connected in cascade, an R-S flip-flop 74, an inverter 75 and an AND gate 76. The clock terminals (CL) of the presettable counters 71, 72 and 73 are connected to the oscillator circuit 1 through the AND gate 76 and the data input control terminals (PE) of the presettable counters 71, 72 and 73 and the input terminal of the inverter 75 are respectively connected to the $Q_3$ output terminal and $Q_5$ output terminal of the divider and counter 64 whereby the binary coded injection quantity signal from the logical operation circuit 6 is applied to the presettable counters 71, 72 and 73. The operation of the converter circuit 7 is as follows. When the divider and counter 64 shown in FIG. 9 generates a "1" level at its $Q_3$ output terminal, this "1" level is applied to the data input control terminals (PE) of the cascade connected presettable counters, 71, 72 and 73 which in turn read the binary coded output of the logical operation circuit 6 as a preset value. After the next two clocks, the "1" level generated at the $Q_5$ output terminal of the divider and counter 64 is inverted by the inverter 75 to the "0" level shown by the waveform (*k*) of FIG. 11 and the R-S flip-flop 74 is thus reset. Each of the presettable counters 71, 72 and 73 is constructed as a down counter, so that when the R-S flip-flop 74 is set the AND gate 76 is opened to pass the clock signals from the oscillator circuit 1 and the presettable counters 71, 72 and 73 start their count operations. When the resulting count reaches the preset value, the "0" level shown by the waveform (*l*) of FIG. 11 is generated at the frequency divided output terminal ($C_0$) of the presettable counter 73. This "0" level resets the R-S flip-flop 74, so that a pulse signal having a time width T proportional to the preset value is generated at the output terminal of the R-S flip-flop 74 as shown by the waveform (*m*) of FIG. 11 and this time width T corresponds to the previously mentioned fuel injection quantity $(f_K \cdot Q/N) + D_S + D_E$. When the R-S flip-flop 74 is reset so that the AND gate 76 is closed, the presettable counters 71, 72 and 73 stop the counting and the counting is not restarted until the R-S flip-flop 74 is again set by the "1" level at the $Q_5$ output terminal of the divider and counter 64 in the logical operation circuit 6.

This pulse signal is then employed, after power amplification in the fuel injection means 8, to open the respective fuel injection nozzles, and the power amplification circuit and the fuel injection nozzles will not be described in any detail since they are well known in the art. In other words, the four fuel injection nozzles may be connected in parallel to the power amplification circuit so that fuel is injected into the respective cylinders simultaneously twice for every complete rotation of the engine.

While, in the embodiment of this invention described above, the fuel injection system in accordance with the present invention is used in the operation of a four-cylinder internal combustion engine, the fuel injection system may be readily used in the operation of a six-cylinder internal combustion engine by selecting the frequency division ratio of the engine revolution detecting circuit 5 to bear 3 : 1 division ratio and by properly changing the frequency $f_K$ of the constant signal generated from the constant presetting circuit 2.

Further, the input-output characteristic of the ROM 39 in the intake-air amount detecting circut 3 may be changed to vary the apparent intake-air amount and thereby to compute fuel injection quantities which provide air-fuel ratios having unrestricted characteristics in relation to the amounts of air drawn into the engine.

To adapt the fuel injection system of the present invention to a separate cylinder injection method in which fuel is sequentially injected into the respective cylinders, it is necessary to provide as many converter circuits 7 and the power amplifier circuits of the fuel injection means 8 as there are the cylinders, or alternately reference signals for determining the timing of fuel injection into the respective cylinders may be generated in synchronism with the rotation of the engine crankshaft to distribute the pulse signals from the converter circuit to the respective cylinders.

It will thus be seen from the foregoing description that the fuel injection system according to the invention has among its great advantages the fact that the amount of air drawn into an engine and the number of revolutions of the engine are detected as principal engine parameters and circuitry for computing the quantity of fuel to be injected are comprised of digital elements to digitally compute the fuel injection quantity, thus minimizing the effects of deterioration with temperature, deterioration with time, etc. on the system, eliminating the necessity of adjustments due to the variations in performance among similar electronic elements, ensuring a stable operation of the system against external noise and making the use of integrated circuits possible for reducing the manufacturing cost of the system.

Another great advantage is that multiplication operations are performed by a frequency multiplication method and dividing operations are performed by means of AND gates, thus considerably simplifying the construction of circuitry for computing the proper fuel injection quantity.

What is claimed is:

1. An electronically controlled fuel injection system comprising:

a constant presetting circuit for generating a constant signal having a frequency corresponding to a preset numerical value;

an intake-air amount detecting circuit for generating a binary coded intake-air amount signal corresponding to the amount of air drawn into an internal combustion engine;

an engine revolution detecting circuit for generating an engine revolution pulse signal having a time width inversely proportional to rotational speed of said engine;

an oscillator circuit for generating clock signals of a preset frequency;

a multiplier circuit connected to said constant presetting circuit and said intake-air amount detecting circuit, said multiplier circuit including a voltage controlled oscillator for generating a multiple signal whose frequency is controlled by an input voltage, a frequency divider for dividing said multiple signal in accordance with said intake-air amount signal, and a phase comparator for comparing an output signal of said frequency divider with said constant signal, an output voltage of said phase comparator being applied as said input voltage to said voltage controlled oscillator to make said multiple signal have a frequency corresponding to the product of said constant and said amount of air drawn into said engine;

a logical operation circuit connected to said multiplier circuit connected to said multiplier circuit and said engine revolution detecting circuit for performing a logical operation on said multiple signals and said engine revolution signal and generating a binary coded fuel injection quantity signal which determines the quantity of fuel to be injected into said engine for each unit of rotation of said engine;

a converter circuit connected to said logical operation circuit and said oscillator circuit for generating an injection activation pulse signal having a time width proportional to said fuel injection quantity signal; and fuel injection means connected to said converter circuit for injecting fuel into said engine in response to said injection activation pulse signal.

2. A system according to claim 1, wherein said constant presetting circuit includes cooling water temperature signal generating means for generating a cooling water temperature signal having a variable frequency corresponding to the temperature of cooling water of said engine, throttle opening signal generating means for generating a binary coded throttle opening signal corresponding to the opening of a throttle valve of said engine, and multiplying means connected to said cooling water temperture signals generating means and said throttle opening signal generating means for multiplying the frequency of said cooling water temperature signal in accordance with said throttle opening signal, whereby the frequency of said constant signal is varied in accordance with the operating conditions of said engine.

3. A system according to claim 2, wherein said intake-air amount detecting circuit includes an intake-air amount detector provided in a suction duct of said engine for generating an intake-air amount output voltage corresponding to the amount of air drawn into said engine, a binary counter connected to said engine revolution detecting circuit and said oscillator circuit for counting the number of clock signals supplied from said oscillator circuit in response to said engine revolution pulse signal, a voltage comparator connected to said intake-air amount detector and said binary counter for comparing said intake-air amount output voltage and a voltate corresponding to the count of said binary counter and generating a comparison output signal, memory means connected to said binary counter, and a flip-flop connected to said voltage comparator and said memory means and responsive to said comparison output voltage to stop the counting of said binary counter and cause said memory means to store the count of said binary counter attained by the time that the counting of said binary counter is stopped.

4. A system according to claim 3, wherein said intake-air amount detecting circuit further includes a ready-only memory connected to said memory means for generating a binary coded output proportional to said amount of air drawn into said engine.

5. A system according to claim 3, wherein said logical operation circuit includes a divider and counter connected to said oscillator circuit and said engine revolution detecting circuit for counting said clock signals in response to said engine revolution pulse signal, another binary counter connected to said multiplier circuit and said divider and counter and responsive to a first output signal of said divider and counter for counting said multiple signals for the duration of the pulse time width of said engine revolution pulse signal, and another memory means connected to said divider and counter and said another binary counter for storing the count of said another binary counter as said fuel injection quantity signal in response to a second output signal of said divider and counter.

6. A system according to claim 5, wherein said multiplier circuit includes a phase lock loop circuit arrangement.

7. A system according to claim 5, wherein said converter circuit includes at least one presettable counter connected to said oscillator circuit, said logical operation circuit and said another memory means and responsive to said first output signal of said logical operation circuit for reading as a preset value said count stored in said another memory means as said fuel injection quantity signal and counting said clock signals to generate an output when the count of said clock signals reaches said preset value, and a flip-flop connected to said logical operation circuit and said presettable counter and responsive to the second output signal of said logical operation circuit and the output of said presettable counter for generating said injection activation pulse signal.

8. A system according to claim 7, wherein said converter circuit further includes at least one adder connected between said another memory means and said presettable counter for adding a predetermined binary coded signal to said binary coded fuel injection quantity signal.

* * * * *